United States Patent [19]

Marshall

[11] Patent Number: 4,765,316

[45] Date of Patent: Aug. 23, 1988

[54] SCALP STIMULATOR

[76] Inventor: Walter D. Marshall, 7203 Evans, Houston, Tex. 77061

[21] Appl. No.: 40,094

[22] Filed: Apr. 20, 1987

[51] Int. Cl.[4] ..... A61H 1/00

[52] U.S. Cl. ..... 128/36; 128/39

[58] Field of Search ..... 128/44, 62 R, 34–36, 128/32, 39, 45, 46, 49, 24.2, 64, 54

[56] References Cited

U.S. PATENT DOCUMENTS 3,481,326 12/1969 Schamblin ..... 128/32

4,469,092 9/1984 Marshall et al. ..... 128/62 R

*Primary Examiner*—Edgar S. Burr

*Assistant Examiner*—Huong Q. Pham

*Attorney, Agent, or Firm*—Stephen D. Carver

[57] ABSTRACT

A portable electro-mechanical system stimulates the human scalp by distributing vacuum and vibration generated by apparatus cooperatively operationally confined within a system helmet. A rigid plastic helmet includes an internal housing region in which a self contained vacuum generating motor is preferably vertically disposed for providing a rigorous vacuum. A resilient vibration distribution pad includes a plurality of individual spaced-apart fingers which extend towards and contact the scalp of the user, and between which a plurality of vacuum distribution voids are defined. A vibrator including a high velocity motor whose shaft is coupled to a rotatable eccentric is mechanically linked to the vibration pad, forcing the vibration fingers emanating integrally from the base portion of the pad to transmit vibration to the user's scalp. A dampening pad disposed between the vibration distribution pad and the helmet includes a vacuum port defined in such a position that fluid flow communication between the vacuum generating fan and the helmet housing permits vacuum to be distributed throughout the interior of the helmet and particularly between the downwardly projecting fingers of the vibration distributing pad. In the best mode the distribution pad is of a first density greater than the density of the dampening pad which is sandwiched between it and the confines of the helmet structure.

5 Claims, 6 Drawing Sheets

SCALP STIMULATOR

BACKGROUND OF THE INVENTION

This invention relates generally to scalp massage devices. More particularly, the present invention is concerned with a readily portable scalp massage system in which vacuum suction and vibration are generated and distributed through apparatus enclosed by the helmet associated with the system. The system is believed classified in U.S. Class 128, Subclass 36.

As explained in my prior U.S. Pat. No. 4,469,092, a number of inventors have previously recognized the desirability of stimulating the human scalp, and a variety of electromechanical stimulating devices have been disclosed. Many known prior art devices typically include some form of movable or vibrating structure which massages the human scalp to promote health. For example, U.S. Pat. No. 3,753,853 issued Oct. 9, 1973, discloses a head vibrator including a plurality of massaging fingers projecting inwardly from a housing to contact the human skull. A vibrating system is employed to gently massage the skull by manipulating mechanical fingers.

U.S. Pat. Nos. 2,427,610 and 849,844 both depict vibrating devices which, when suitably placed relative to the skull of the wearer, stimulate the scalp by direct physical contact by a variety of moving fingers or "applicators". Other relatively similar devices are shown in U.S. Pat. Nos. 2,914,065 and 2,232,254. U.S. Pat. No. 2,706,980 discloses a scalp massage implement in which fingers are operated independently in separate groups. U.S. Pat. No. 1,861,924 discloses a vacuum operated head in which vibration is produced by air forced through a turbine system. The turbine includes eccentric weights for producing vibration. The latter device employs vibration in conjunction with suction to dislodge dirt particles for more effective vacuuming.

U.S. Pat. No. 4,469,092, issued to me on Sept. 4, 1984 discloses a scalp stimulating system which combines the advantage of rapid vibration distributed over a wide area of the scalp with concurrent suction. However, I have found it desirable to provide a scalp stimulating device in which the vacuum and vibration system are operationally associated within the helmet structure so as to more completely distribute massaging effects, while facilitating the comfort and convenience of the user.

SUMMARY OF THE INVENTION

The present invention comprises an electro-mechanical system for stimulating the human scalp, in which the major operative vibration and suction systems are cooperatively operationally confined within the system helmet.

The invention is a portable system adapted to be worn by the user for massaging and stimulating the human scalp through the combined attributes of vacuum and mechanical stimulation. Preferably the system of the instant invention comprises a rigid plastic helmet somewhat greater in size than the head of the wearer or user. The helmet includes an internal housing region in which a self contained vacuum generating motor is disposed for providing a vacuum source to associated apparatus.

A resilient vibration distribution pad including a plurality of individual fingers which extend towards the scalp of the user is stimulated by the helmet system.

This pad includes a plurality of individual spaced-apart fingers defining a plurality of voids therebetween through which vacuum may be passed. A suitable vibrator including a high velocity motor whose shaft is coupled to a rotatable eccentric provides vibration. Specifically, the vibration means includes a motor having a surrounding mounting system adapted to be coupled to the base portion of the vibration distribution pad. The vibration distribution fingers of said pad emanate integrally from the base portion of the pad and more adapted to transmit vibration to the user's scalp. Also, these fingers help distribute vacuum so that suction is relatively homogeneously applied to the wearer.

An integral housing associated with the helmet of the system receives a rotatable fan which provides vacuum to the system. Importantly, the axis of rotation of the fan motor is disposed generally parallel with the neck of the wearer.

In the best mode a dampening pad is disposed between the vibration distribution pad and the helmet. However, the dampening pad includes a vacuum port defined in such a position that fluid flow communication between the vacuum generating fan and the helmet housing permits vacuum to be distributed throughout the interior of the helmet and particularly between the downwardly projecting fingers of the vibration distributing pad. Preferably the vibration distribution pad includes a central substantially elliptical region integrally interconnected with a plurality of radially spaced apart, separate outwardly extending spokes which include operational vacuum distribution edges. When properly assembled into the curved inner surfaces of the helmet, these spokes include edges which form vacuum distribution passageways for the effectuation of total vacuum distribution within the confines of the helmet apparatus. In the best mode the distribution pad is of a first density greater than the density of the dampening pad which is sandwiched between it and the confines of the helmet structure.

Thus an object of the present invention is to provide a system for stimulating the human scalp which, when worn by the user, allows him substantially more freedom of movement than known prior art devices.

A primary object of the present invention is to provide a comfortable, easy-to-use scalp stimulator system which promotes the growth of hair upon the human scalp.

Yet another object of the present invention is to combine vacuum with mechanical vibration in a self contained helmet system to produce a stimulating and healthy effect upon the human scalp.

Yet another object of the present invention is to provide a system of the character described in which vibration and vacuum are uniformly distributed about the scalp of the user, without the use of elongated vacuum hoses.

Yet another object of the present invention is to provide an electro-mechanical system for stimulating hair growth.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION

Figure 12:
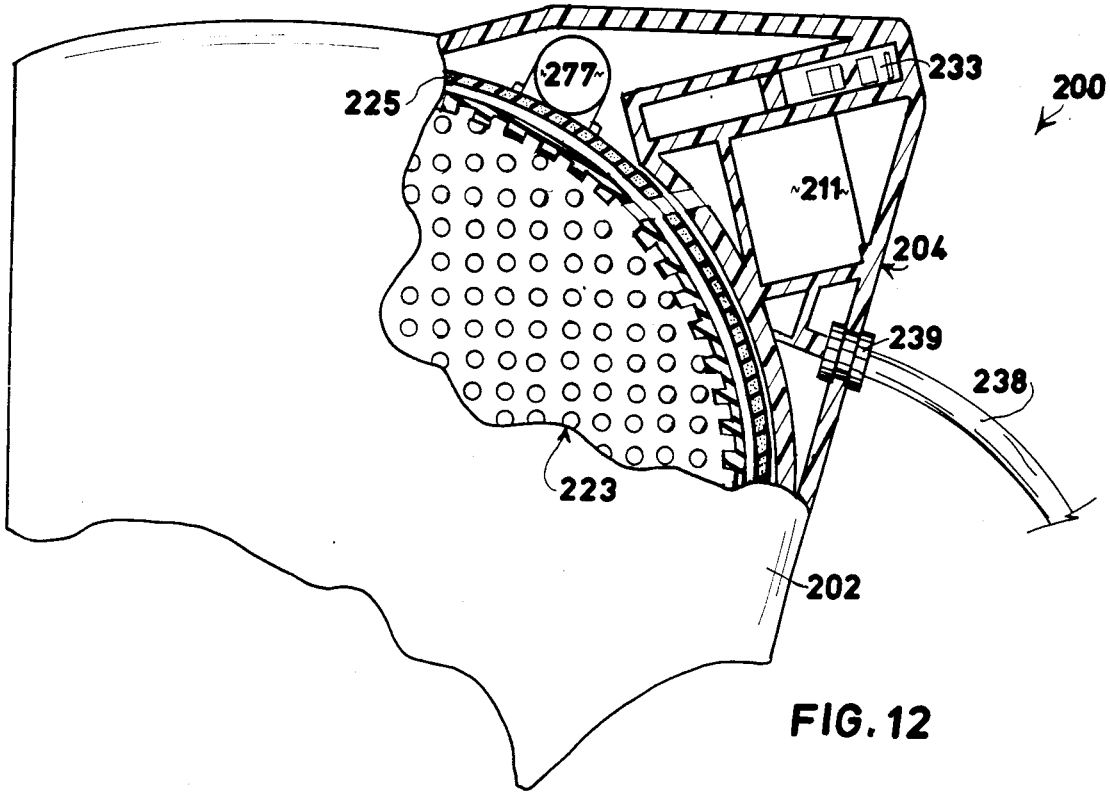
FIG. 12 is a fragmentary, sectional view of the preferred helmet suction system, showing the vibration compartment and the vertical suction generator used in the best mode.
Figure 13:
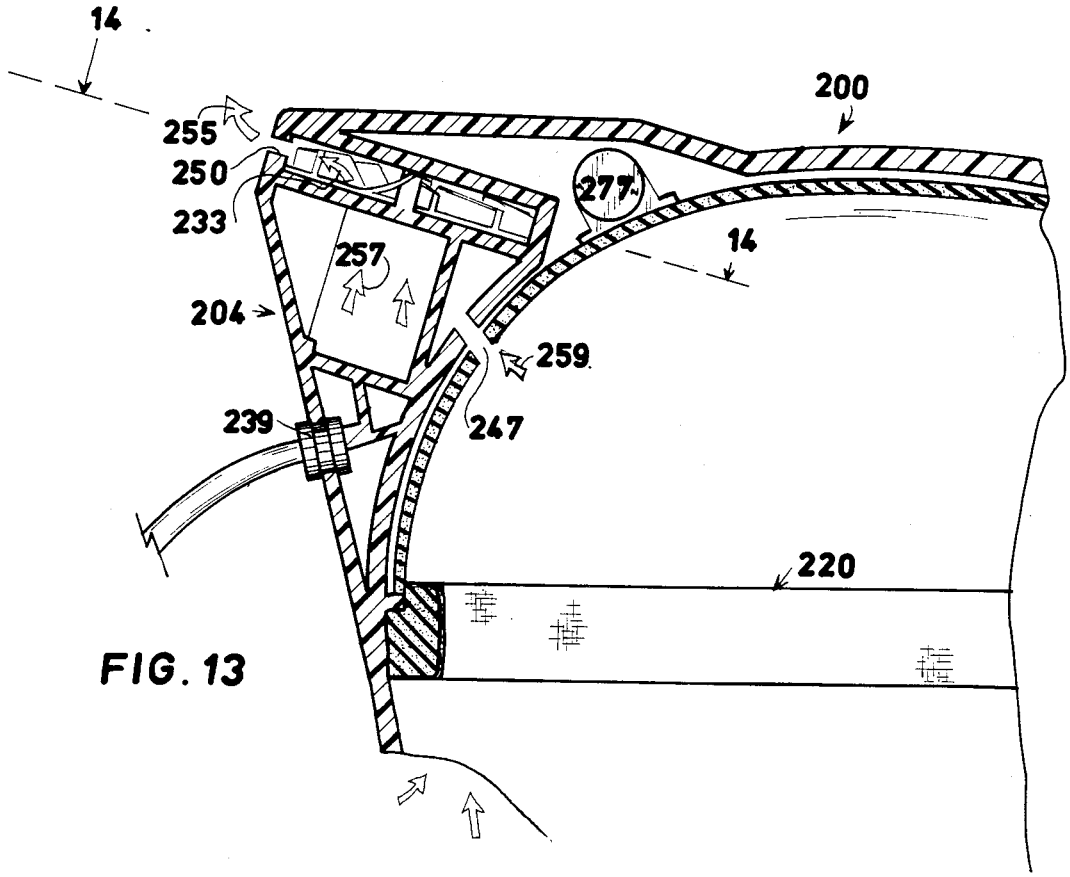
FIG. 13 is a fragmentary sectional view of the preferred embodiment of FIG. 12 generally illustrating the air flow path; and, FIG. 14 is a substantially enlarged fragmentary sectional view taken generally along line 14—14 of FIG. 13.
Figure 14:
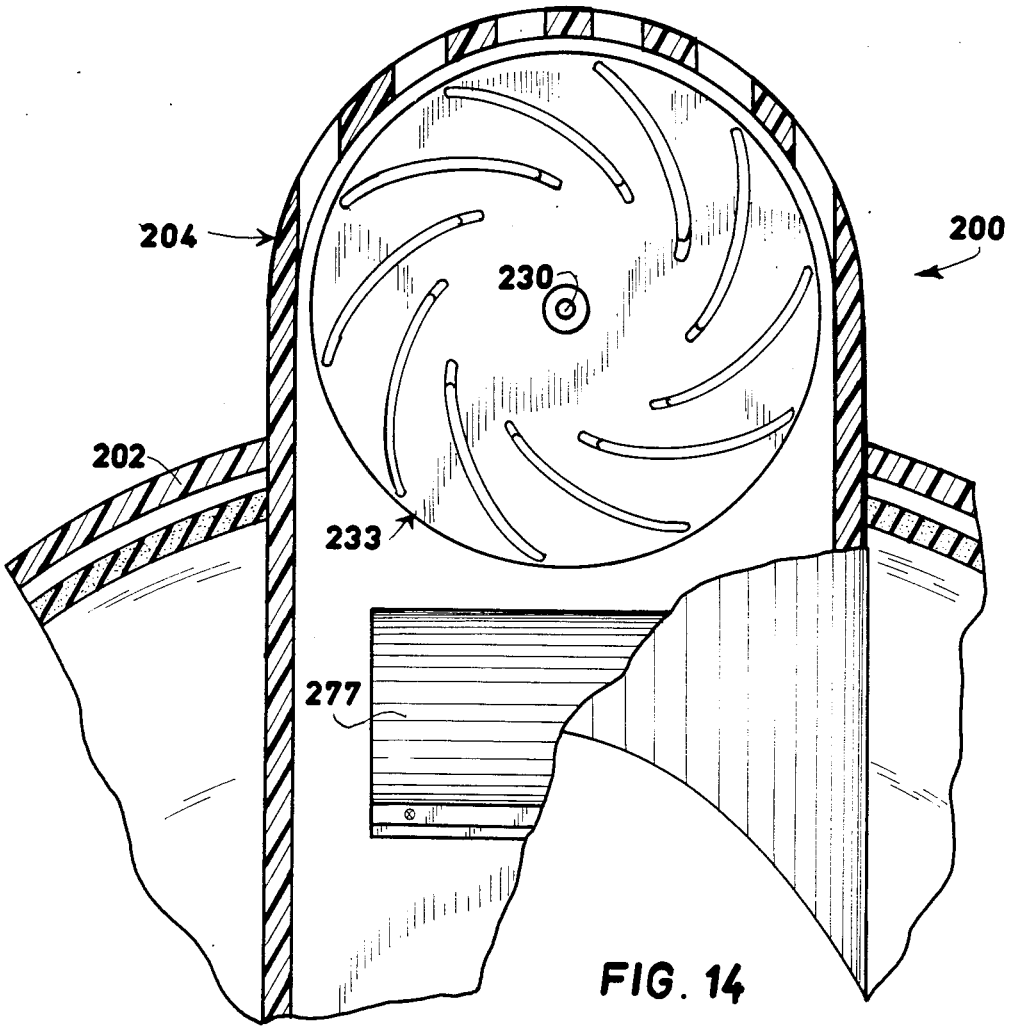

With initial reference now directed to FIGS. 1–10 of the appended drawings, a scalp stimulation system constructed in accordance with teachings of the present invention has been generally designated by the reference numeral 20. System 20 basically comprises a helmet, broadly designated by the reference numeral 22, which is adapted to be worn upon the head 24 of the user 26. The helmet 22 is preferably somewhat greater in size than the head 24 of the typical user 26, so as to be readily comfortably fitted thereupon. The best mode presently known to me, wherein internal vacuum is generated with a generally vertically disposed motor, is illustrated in FIGS. 12–14.

System 20 is preferably electrically powered through a remote electrical outlet 30 into which a conventional plug 32 is manually inserted. Power line 34 leads to a conventional series connected, snap fitting on/off switch 36 which delivers power via line segment 38 to a fan motor 40 and vibration motor 42 disposed within helmet 22. Fan motor 40 drives a shaft 101 for driving a fan 44 to produce vacuum within the vacuum chamber within helmet 22 in response to rotation of its radially spaced apart blades, as will hereinafter be described. Importantly, the shaft 101 is disposed generally horizontally between tab 94 and internal wall 106.

With reference now directed to FIGS. 2–7, helmet 22 includes a hollow interior generally designated by the reference numeral 45 into which a plurality of cooperating elements of the device to be hereinafter described are fitted. Helmet 22 includes a pair of opposed, spaced apart sides broadly designated by the reference numerals 48 and 50 which are integral with a front 52 and a rear 54. The top of the helmet has been generally designated by the reference numeral 56 (FIGS. 1 and 2), and the interior wall of top 56 has been generally designated by the reference numeral 56A. Top 56 is integral with the somewhat cubical housing portion broadly designated by the reference numeral 58. Housing 58 is adapted to operationally receive and confine the vibration and vacuum generating apparatus.

Figure 1:
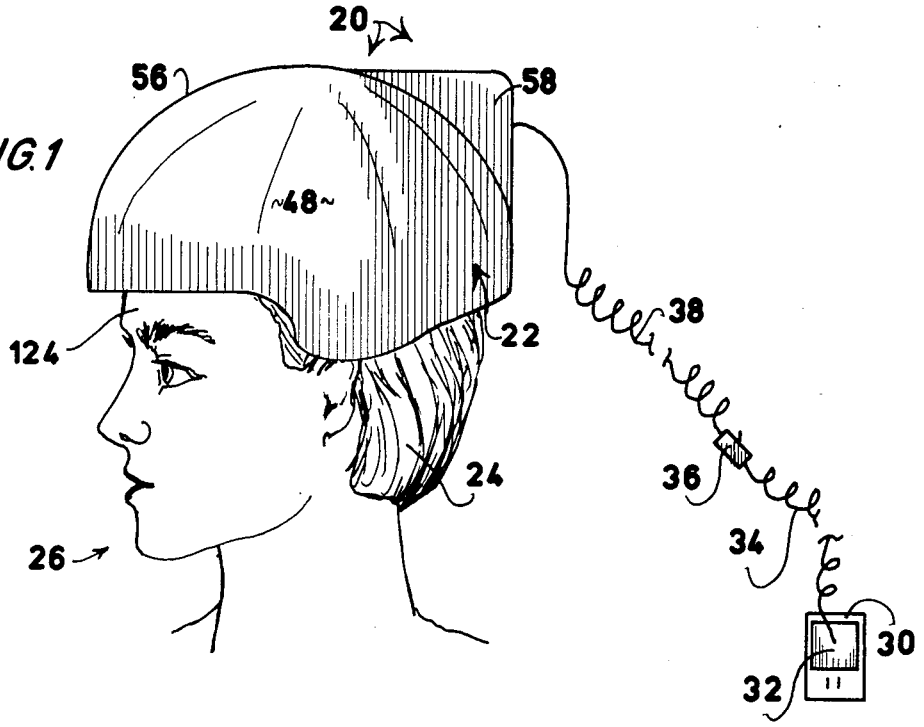
FIG. 1 is a fragmentary pictorial view of a Scalp Stimulator constructed in accordance with the teachings of the present invention.
Figure 2:
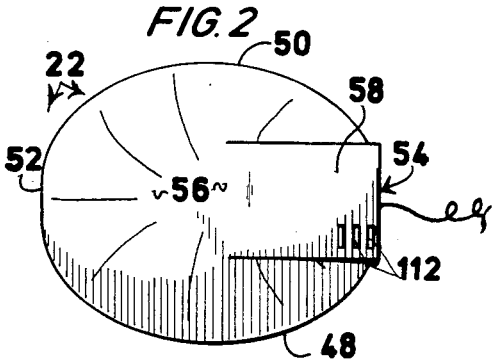
FIG. 2 is a fragmentary top plan view of the helmet apparatus of FIG. 1.
Figure 3:
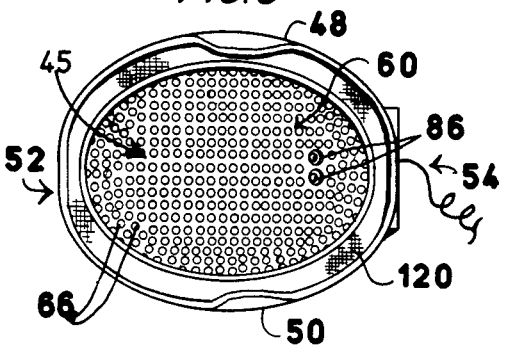
FIG. 3 is a fragmentary bottom plan view thereof, illustrating the interior of the helmet.
Figure 4:
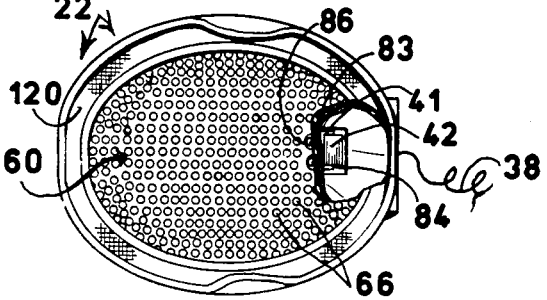
FIG. 4 is a fragmentary bottom view similar to FIG. 3, illustrating placement of the vibration motor housing.
Figure 5:
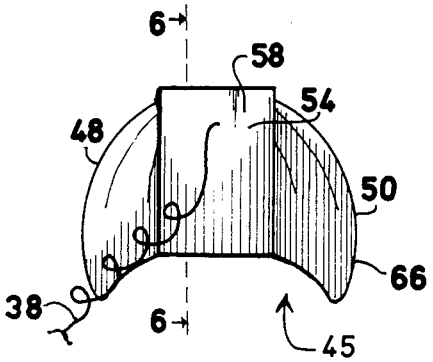
FIG. 5 is a fragmentary rear elevational view of the helmet apparatus of FIGS. 1–4.
Figure 6:
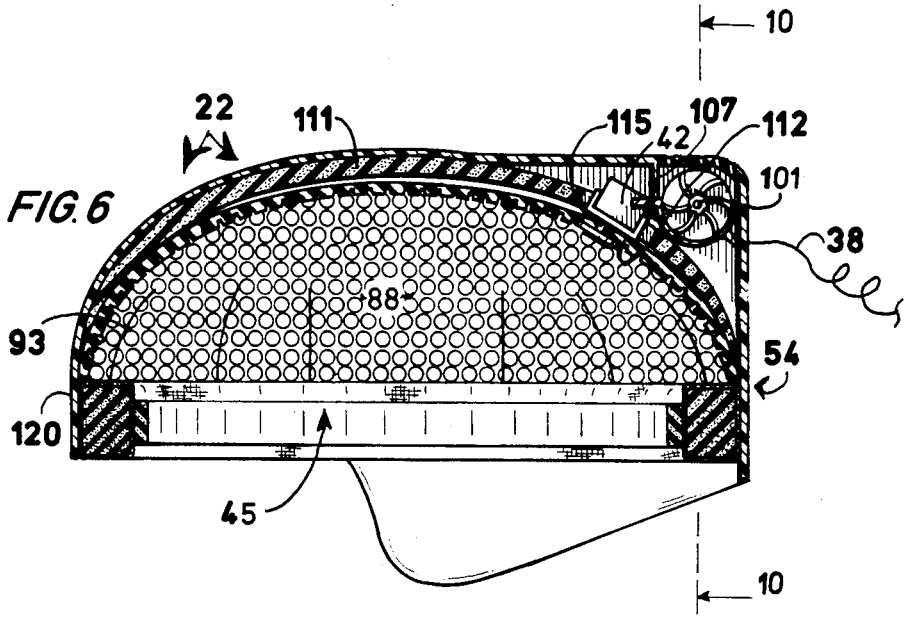
FIG. 6 is an enlarged scale, fragmentary, sectional view taken generally along line 6—6 of FIG. 5, with portions thereof omitted for clarity.
Figure 7:
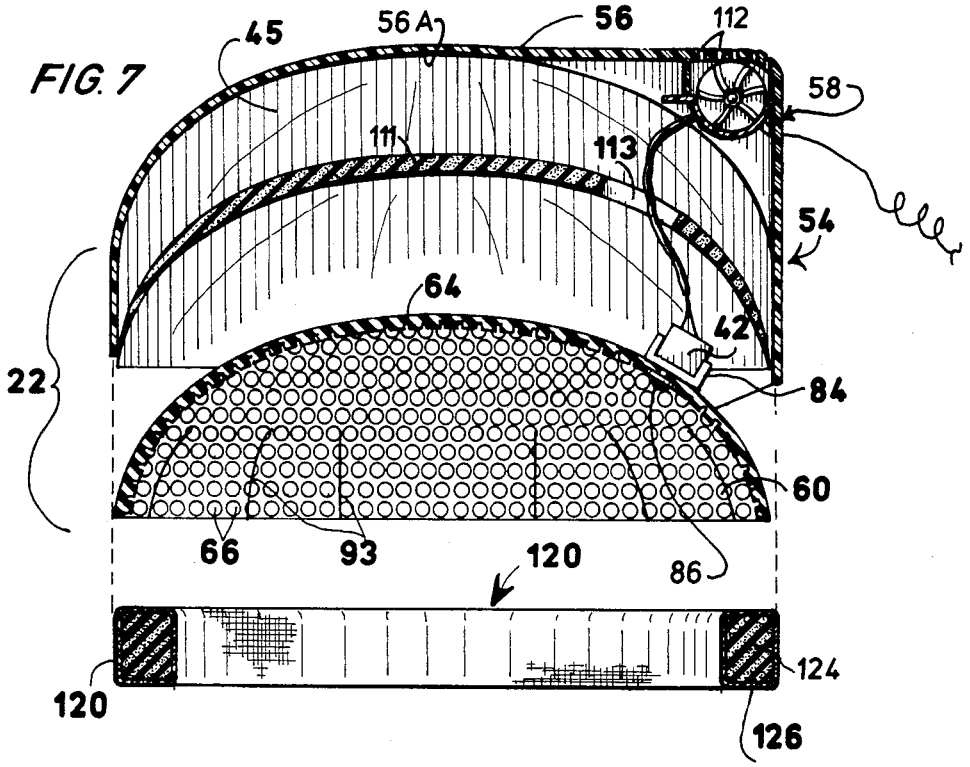
FIG. 7 is an enlarged scale, exploded, fragmentary, view of the apparatus of FIG. 6, with portions thereof omitted for brevity.
Figure 8:
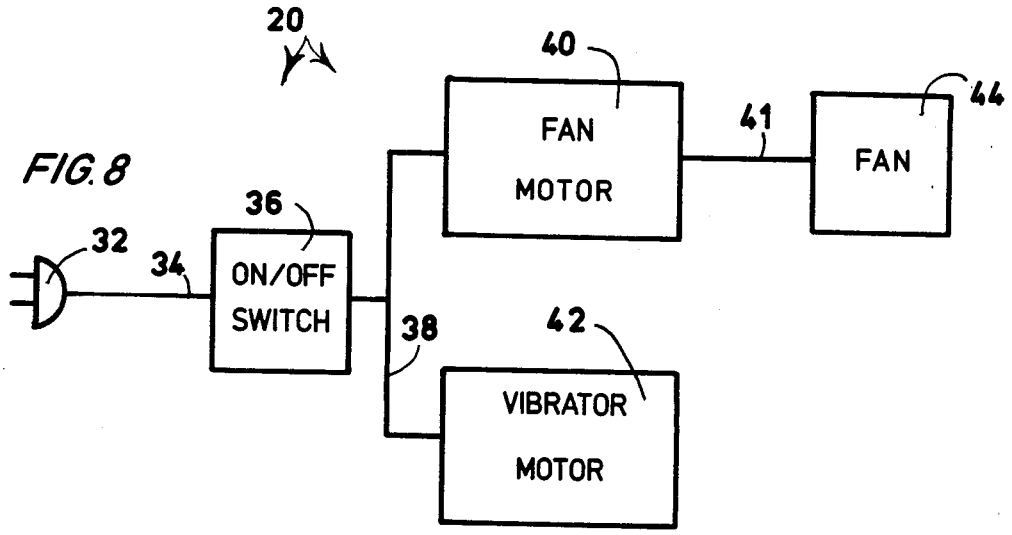
FIG. 8 is an electrical block diagram of both embodiments of the invention.
Figure 11:
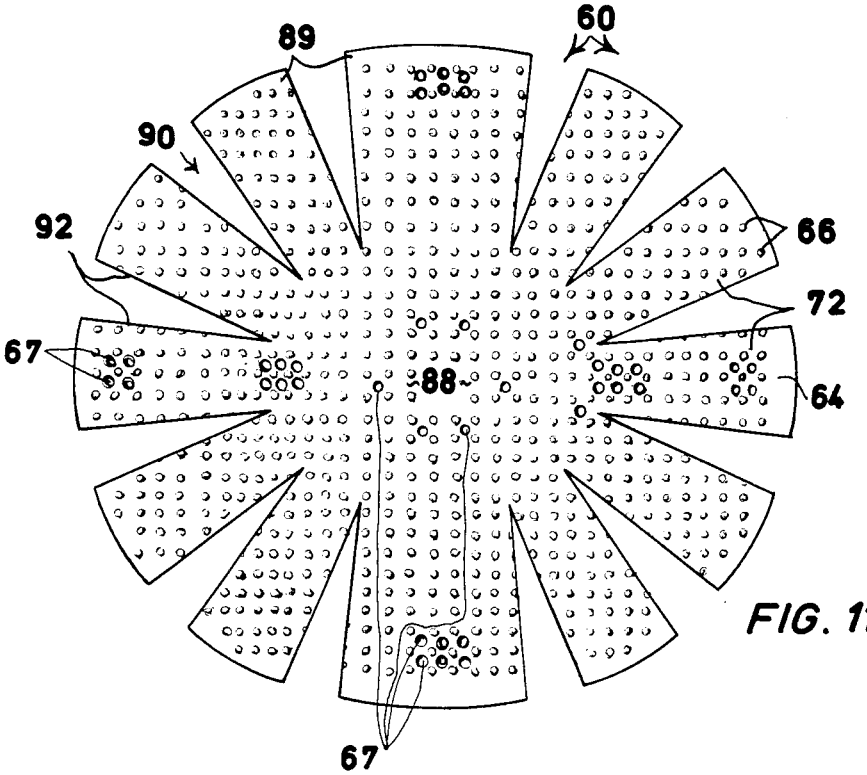
FIG. 11 is an enlarged scale, bottom plan view of the preferred vibration distribution pad as it appears prior to being folded and installed within the helmet.

With reference directed now to FIGS. 3, 4, 6, and 7, a resilient generally elliptically shaped vibration distribution pad has been generally designated by the reference numeral 60 (FIG. 11). Pad 60, as best viewed in FIG. 7, is adapted to be received within the interior 45 of helmet 22 and it is preferably arcuately configured as illustrated in FIGS. 6 and 7. Vibration distribution pad 60, which is preferably formed of urethane, comprises a resilient base 64 from which a plurality of integrally formed, outwardly extending fingers 66 emanate. When the helmet is worn by user 26 the fingers 66 physically contact and stimulate the scalp in response to vibration from motor 42. As best noted in FIG. 11, the pad 60 includes a central portion broadly designated by the reference numeral 88 which includes a plurality of integral, radially spaced apart and outwardly extending spokes 89. These spokes are separated by voids 90 which are defined between adjacent edges 92 of adjacent spokes. Once fitted within the helmet (as indicated generally in FIGS. 6 and 7, for example) the plurality of seams 93 defined between adjacent edges 92 provide vacuum distribution passageways through which vacuum may be passed in cooperation and hence distributed to the scalp of the user. A plurality of voids generally designated by the reference numeral 72 are defined between each of the multiplicity of adjacent fingers 66. It will be noted that a plurality of vent orifices 67 are defined within the pad in void regions 72 to help distribute vacuum.

Figure 9:
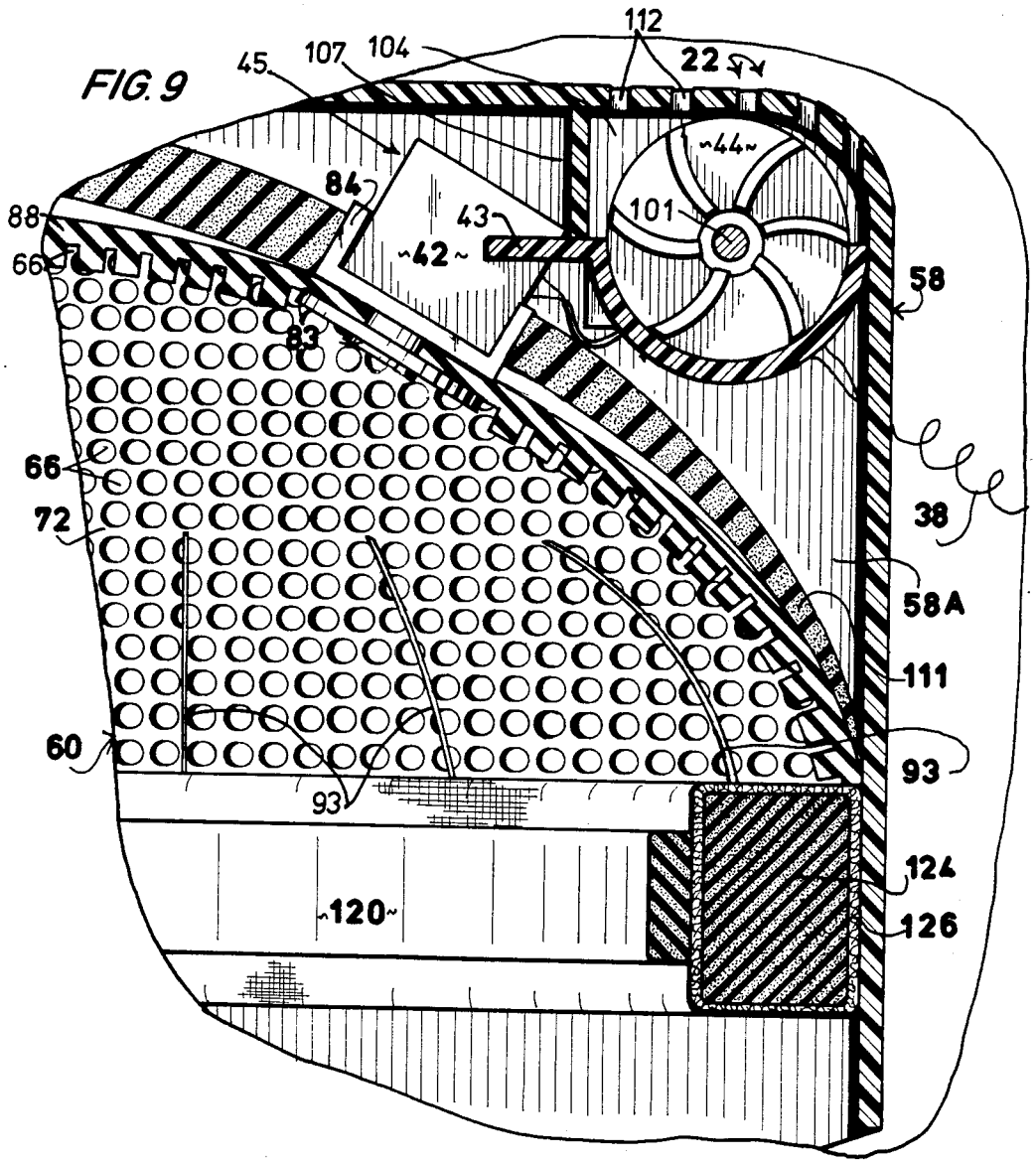
FIG. 9 is an enlarged scale, fragmentary, sectional side view similar to that of FIG. 6, primarily illustrating the vibration generator and the horizontal vacuum generator.

As best illustrated in FIGS. 7 and 9, the preferred vibration means of the present system comprises vibrator motor 42 which rotatably drives an eccentric 83 to induce vibration. The motor is mounted by a generally U-shaped clamp 84 which is operationally secured between integral braces 43 defined within housing 58. Additionally, a pair of fasteners such as rivets 86 (FIG. 4) secure the pad 60 to help distribute vibration through its multiple fingers 66.

Figure 10:
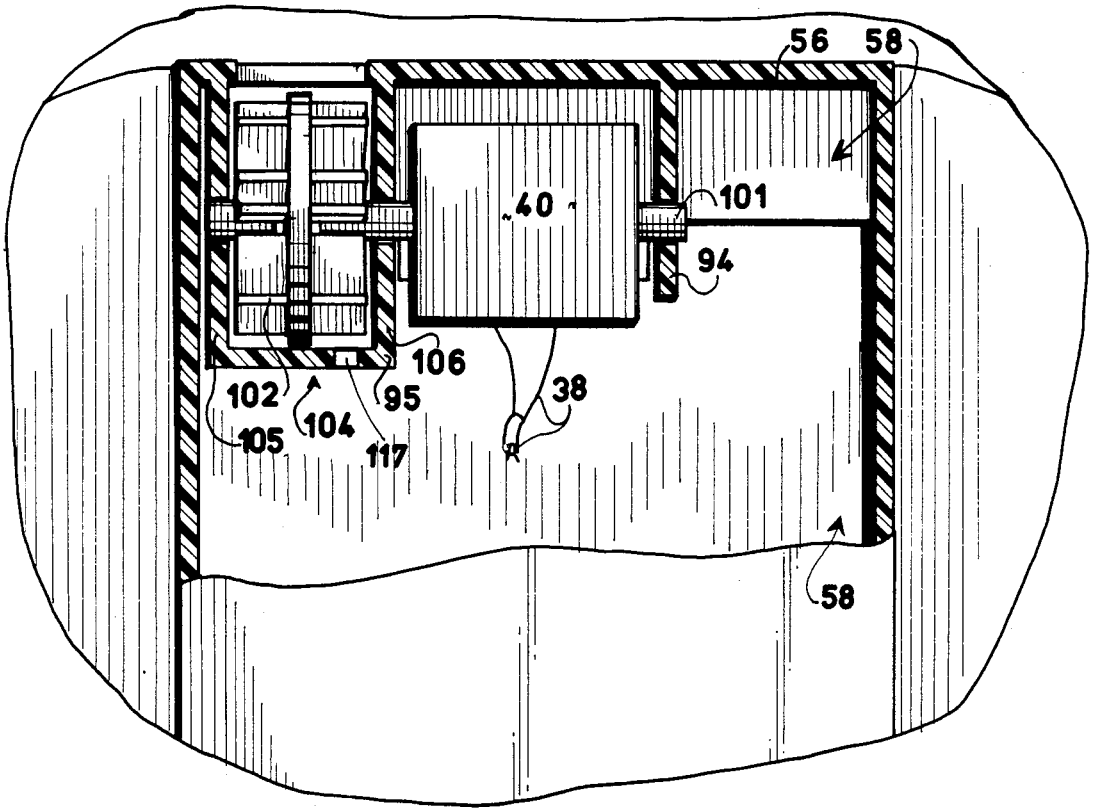
FIG. 10 is a greatly enlarged scale, fragmentary, sectional view taken generally along line 10—10 of FIG. 6.

With particular reference directed to FIG. 10, one fan means of the present system comprises a conventional fan motor 40 secured between tabs 94 and vacuum compartment side wall 106 (FIG. 10) defined within the housing region 58 of the helmet as previously described. Motor 40 is attached to a shaft 101 which drives the fan blades 102 of conventional fan 44 housed within a vacuum compartment 104 defined between opposite interior side walls 105 and 106 (FIG. 10) and the transverse wall 107 (FIG. 9). The blades 102 provide suction, so that the interior of the helmet 22 is subject to vacuum. As best viewed in FIG. 9 a plurality of exhaust vents 112 exhaust air from the vacuum compartment 104 housing 58, and vacuum from compartment 104 may be supplied through vent orifices 117 (FIG. 10) to vacuum distribution region 115 within the interior of housing 58. Vacuum reaches helmet interior 45 through orifice 113, passing through pad vent orifices 67 and between pad seams 93.

As best viewed in FIG. 7, a resilient dampening pad has been generally designated by the reference numeral 111. Pad 111 is adapted to conform to the interior wall 56A (FIG. 7) of helmet 22, and it is operationally disposed above vibration distribution pad 60 beneath interior helmet wall 56A. Pad 111 includes an orifice 113 which is adapted to be aligned within the vacuum distribution region 115 (FIG. 6). Vacuum distributed through orifice 113 is distributed through the pad vent orifices 67 (FIG. 11) and between the pad seams 93 so that air is passed around downwardly projecting fingers 66 into contact with the scalp of user 26. It will be appreciated that the pad fingers are thus influenced both by vibration transmitted from vibrator 42 and from the turbulence caused by the distributed suction between adjacent pad fingers. The distribution pad is preferably of a density greater than the density of the dampening pad.

Preferably a lower circumferential cushion 120 of generally elliptical dimensions is fitted within the interior periphery of helmet 22, as best viewed in FIGS. 6 and 9. Cushion 120 is adapted to completely surround the forehead 124 of user 26. Preferably cushion 120 comprises an interior ring 125 of suitable material such as foam rubber or the like and a fitted, preferably removable cover of a suitably absorbent, preferably washable material, such as a cotton stretch knit, cotton terrycloth, or the like. Cushion 120 is preferably removable secured along the interior of helmet 22 by suitable fasteners (not shown) such as Velcro-brand fastening strips or the like.

The best mode contemplates the vacuum compartment configuration of FIGS. 12–14. The alternative helmet generally designated by the reference numeral 200 includes a helmet portion 202 similar to that previously described except for the "vertical" vacuum chamber 204. As before, a resilient circumferential cushion 220, a vibration distribution pad 223, and a dampening pad 225 are disposed within the helmet for distributing vacuum and vibration to the scalp of the user.

The vacuum subcompartment 204 receives power through power line 238 transmitted through grommet 239 for electrical contact with conventional motor 212. Motor 212 includes a shaft 230 (FIG. 14) which drives a rotatable fan assembly 233. The axis of rotation of motor 212 is substantially parallel with the neck of the wearer. Air drawn through orifice 247 (FIG. 13) enters the vacuum subcompartment 204 and its drawn out by fan blades 233 through orifices 250 (FIG. 13). Vacuum distribution air flow is generally indicated by the arrows 225, 257, and 259 in FIG. 13. Vibrator 277 is essentially similar to that previously described.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A portable system for concurrently producing suction and massaging to stimulate the human scalp, said system adapted to be at least temporarily disposed upon the head of a wearer to be treated, said system comprising:

a rigid helmet somewhat greater in size than the head of said wearer for substantially covering the head of the wearer to be treated, said helmet comprising:
an internal helmet wall;
a hollow interior;
a lower internal periphery; and
peripheral cushion means adapted to be secured within said internal periphery for aiding the wearing of said helmet by contacting the lower portion of the wearer's head and for providing a vacuum seal;

a resilient vibration distribution pad disposed within said helmet comprising a generally planar base portion and a plurality of individual, spaced apart finger members integrally emanating away from said base portion for directly contacting the scalp of said wearer when said helmet is worn, and a plurality of vent orifices;

vibration means disposed within said housing within said helmet for vibrating said distribution pad fingers to massage the wearer's scalp, said vibration means comprising:
motor means for generating vibrations; and,
mounting means for securing said motor means within said housing, said mounting means rigidly coupled to at least a portion of said vibration pad base portion;

vacuum fan means rotatably disposed within said helmet for concurrently supplying vacuum interiorly of said helmet;

fan motor means for powering said fan means;

said helmet comprising exhaust vents for exhausting said vacuum fan means and a vent orifice in fluid flow communication with said exhaust vent;

dampening pad means disposed within said helmet between said vibration distribution pad base and said internal helmet wall for dampening vibrations, said pad means comprising an orifice adapted to be disposed in fluid flow communication with said vent orifice; and, wherein said orifice is operatively defined adjacent said fan motor means to maximize motor cooling.

2. The system as defined in claim 1 wherein:

said distribution pad comprises a central portion, and a plurality of integral, radially outwardly extending spokes separately projecting from said central portion; and, a plurality of elongated vacuum distribution passageways are defined between the edges of adjacent ones of said distribution pad spokes for operatively conducting vacuum of the spaces between said fingers whereby to expose said scalp to suction.

3. The system as defined in claim 2, wherein said fan motor means is positioned within said helmet with its axis of rotation generally parallel with the neck of the wearer.

4. The system as defined in claim 3 wherein the density of said distribution pad is greater than the density of said dampening pad.

5. A portable scalp massaging and stimulating system, said system adapted to be at least temporarily disposed upon the head of a wearer to be treated, said system comprising:

a rigid helmet somewhat greater in size than the head of said wearer, said helmet comprising:

a hollow interior having an internal surface;

exhaust vent;

a vent orifice in fluid flow communication with said exhaust vents for internally distributing vacuum within said helmet interior;

a lower internal periphery;

a peripheral cushion adapted to be secured within said internal periphery for providing a comfortable fit and an improved vacuum seal by contacting the lower portion of the wearer's head;

a resilient vibration distribution pad disposed within said helmet comprising:

a base portion;

a plurality of individual, spaced apart finger members integrally emanating from said base portion for directly contacting the scalp of said wearer;

a plurality of elongated vacuum distribution passageways for operatively conducting vacuum to the spaces between said fingers whereby to expose said scalp to suction;

vibration means disposed within said helmet for vibrating said distribution pad finger members to massage the wearer's scalp, said vibration means comprising motor means for generating vibrations, mounting means rigidly coupled to said vibration distribution pad for securing said motor means within said helmet;

fan means rotatably disposed within said helmet for concurrently supplying vacuum interiorly of said system, said fan means driven by a motor means, wherein the fan means establishes an axis of rotation, said axis of rotation oriented substantially parallel to the neck of said wearer;

pad means for dampening vibrations, said last mentioned pad means disposed within said helmet between said vibration distribution pad and said internal surface, said dampening pad comprises an orifice adapted to be disposed in fluid flow communication with said vent orifice; and, wherein said vibration motor means is operatively positioned adjacent said orifice.

* * * * *